United States Patent [19]

Siqveland

[11] Patent Number: 4,805,240

[45] Date of Patent: Feb. 21, 1989

[54] PERSPIRATION RESISTANT GARMENT AND METHOD FOR PREPARING SAME

[75] Inventor: Thomas T. Siqveland, St. Paul, Minn.

[73] Assignee: Sumday Enterprises, Inc., St. Paul, Minn.

[21] Appl. No.: 667,829

[22] Filed: Nov. 2, 1984

[51] Int. Cl.[4] ..... A41D 27/12; C07F 29/16

[52] U.S. Cl. ..... 2/54; 2/DIG. 1; 2/DIG. 5; 2/115; 2/125

[58] Field of Search ..... 2/53, 54–58, 2/115, 125, 126, 123, 135, DIG. 1, DIG. 5; 524/544, 169

[56] References Cited

U.S. PATENT DOCUMENTS

| | | | |
|---|---|---|---|
| 338,002 | 3/1886 | Taylor et al. | 2/54 |
| 349,068 | 9/1886 | Taylor et al. | 2/54 |
| 397,543 | 2/1889 | Goldsmith | 2/DIG. 1 |
| 2,238,466 | 4/1941 | Gardner | 2/54 |
| 2,516,800 | 7/1950 | Rand | 2/58 |
| 3,089,806 | 5/1963 | Mizell | 2/53 X |
| 3,277,039 | 10/1966 | Marascia et al. | 524/544 |
| 3,421,514 | 1/1969 | Friedlander | 2/54 X |
| 3,474,465 | 10/1969 | Artzt | 2/113 |
| 3,575,899 | 4/1971 | Pryor et al. | 524/544 X |
| 3,801,987 | 4/1974 | Thompson | 2/DIG. 1 |
| 4,215,205 | 7/1980 | Landucci | 524/169 |

FOREIGN PATENT DOCUMENTS

| | | | |
|---|---|---|---|
| 2362817 | 6/1975 | Fed. Rep. of Germany | 2/54 |

*Primary Examiner*—Louis K. Rimrodt
*Attorney, Agent, or Firm*—James R. Haller

[57] ABSTRACT

The underarm areas of shirts may be treated with a water-repellent material to render only the underarm areas of a shirt nonabsorbent of perspiration while yet permitting perspiration to transfer through the underarm fabric areas. A shirt so treated thus has underarm areas that are nonabsorbent of perspiration, and non-underarm areas which absorb perspiration in the usual manner.

5 Claims, 1 Drawing Sheet

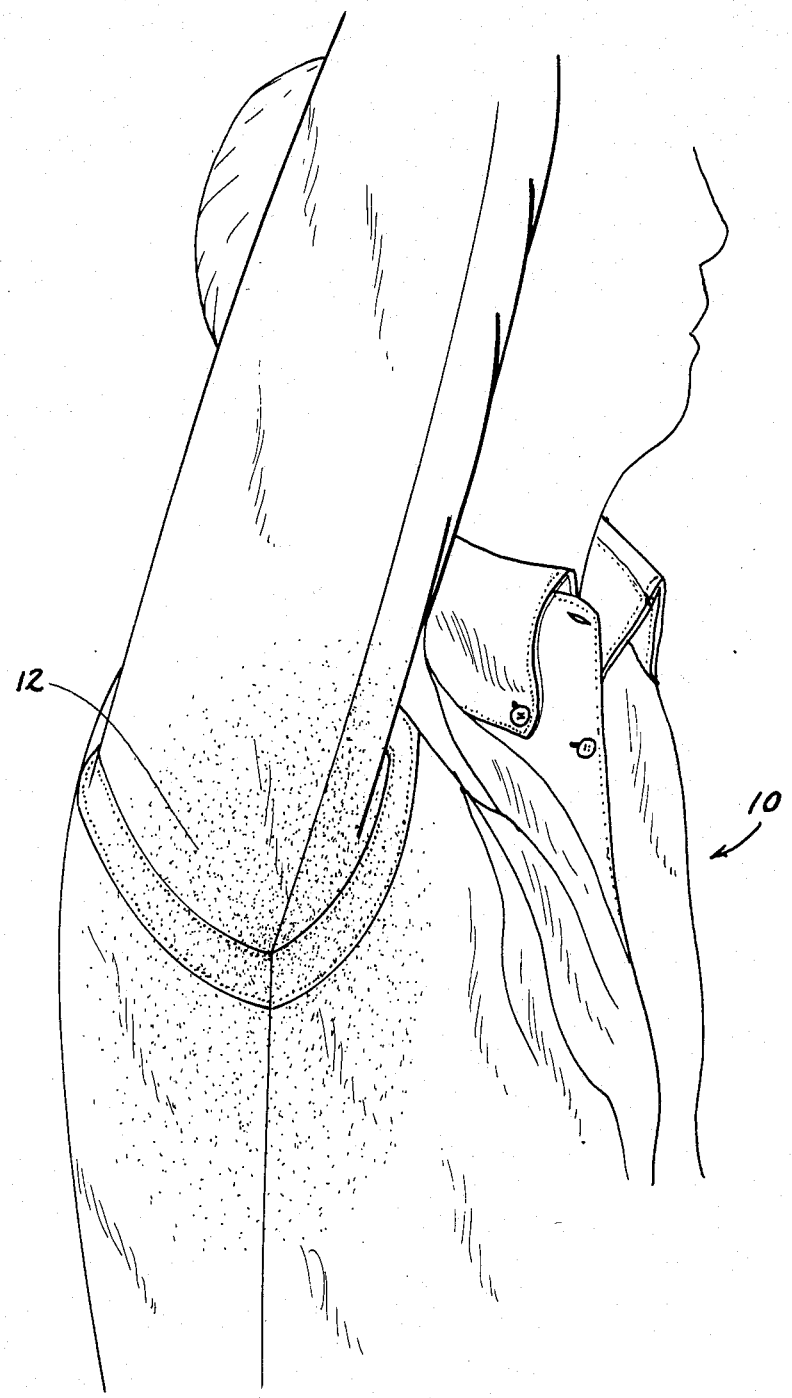
12
10

PERSPIRATION RESISTANT GARMENT AND METHOD FOR PREPARING SAME

FIELD OF THE INVENTION

This invention relates to clothing and particularly to shirts and to shirt fabric treatments.

BACKGROUND OF THE INVENTION

A great many individuals, primarily, but not exclusively male, suffer from embarrassing underarm shirt stains due to excessive perspiration which cannot be controlled through the use of various antiperspirant products. The stains are primarily due to a wetting of the shirt fabric fibers, and the wet areas are particularly noticeable with the darker pastel shades of shirts, the wetness appearing in the form of dark underarm blotches.

SUMMARY OF THE INVENTION

I have found that the dark wet blotches due to excessive perspiration can be substantially completely avoided by treatment of the underarm areas of a shirt with known water-repellent materials such as fluorocarbons or silicones. The type and amount of water-repellent material is selected so as to substantially prevent the absorption of perspiration into the fibrous, normally water-absorbent threads of the shirt fabric in underarm areas, but to yet permit perspiration to pass through the fabric. The perspiration may thus evaporate from the outer surface of the fabric, or may pass into outer clothing which can then be cleaned as needed. In this manner, the healthy flow of perspiration is not impeded, but the formation of wetness stains in underarm shirt areas is avoided.

DESCRIPTION OF THE DRAWING

The FIGURE is a perspective view of a shirt treated in accordance with the invention, an underarm area being generally shown by stippling.

DESCRIPTION OF THE PREFERRED EMBODIMENT

Shirts (including blouses and other garments having arms) applicable to the invention are those which are made of water absorbent fabrics such as cotton or cotton-polyester blends and which tend to darken when the fibrous threads from which the shirt fabric is woven are wetted with perspiration. With cotton-polyester blends, the absorbency of the fibrous threads is reduced as the proportion of polyester to cotton fibers is increased. Generally, fabric made of most polyester/cotton blends are sufficiently absorbent so as to exhibit dark stains when wetted with perspiration. The invention yields best results with shirt fabrics in which the percent of polyester to cotton (as appears on the label) ranges from about 20/80 to about 80/20.

The water-repellent material employed in the invention may be any of various commercial materials but preferably is a fluorocarbon such as that marketed by 3M Company under its trademark "Scotchgard". The water-repellent material may be liquid or solid and may be dissolved in a liquid vehicle or otherwise carried by a liquid vehicle. It may be applied to the underarm areas of a shirt by, preferably, spraying the material onto the outer surface of the underarm shirt areas. The water-repellent material must be capable of binding or adhering to the fibrous threads of the shirt fabric sufficiently as to render the threads nonabsorbent of perspiration. Yet, the water-repellent material desirably can be removed at least partially from a shirt when it is laundered.

Fluorocarbon water-repellent materials are well known and commonly include fluoroaliphatic resins, particularly fluoroaliphatic vinyl resins. Reference is made to U.S. Pat. No. 4,215,205 (Landucci) for a review of fluorocarbon materials and patent literature relating thereto. See also U.S. Pat. No. 3,227,039 (Marascia) representing one of the earlier patents relating to fluorocarbon textile treatments. Commonly, the fluorocarbon materials are dissolved in a solvent such as 1,1,1-trichloroethane, and may be applied in the form of a spray, the solvent rapidly evaporating from the sprayed fabric surface.

Other water-repellent materials useful in the present invention inlcude silicones and the like, which can be utilized in admixture with fluorocarbons. Fluoroaliphic resins are preferred.

The water-repellent materials are applied sparingly to the shirt fabric so as to avoid undue buildup; this may be accomplished by using quite dilute solutions of the material. The "Scotchguard" brand material referred to above has given good results when used in a 1% by weight solution in 1,1,1-trichloroethane.

In general, the water-repellent material of the invention should be insoluble in water, should bind sufficiently to the fibrous threads of the shirt material as to continuously function while the shirt is being worn, should be non-toxic to the wearer, should not itself noticeably affect the color or other appearance of the shirt material to which it is applied, and should prevent perspiration from soaking into or being absorbed by the fibrous threads. The material must not, on the other hand, so clog the openings between fibrous threads as to prevent the flow of perspiration through the fabric.

As mentioned above, the water-repellent material desirably is applied only to the underarm areas of shirts by spraying, and desirably the water-repellent material is contained in a spray bottle of any desired design or type that enables the repellent, in its liquid vehicle, to intimately contact the shirt fabric. When fluorocarbon materials of the type described above are employed, the underarm areas of a shirt desirably are sprayed thoroughly with the water-repellent material so that the underarm areas appear wetted. Evaporation of the solvent or other vehicle restores the shirt to its prior appearance. In this manner, it appears that the water-repellent material comes into intimate contact with fibrous threads of the shirt fabric throughout the thickness of the fabric in the underarm areas. Remaining areas of the shirt desirably are not so treated. Additional expense and effort thus are avoided. Only the underarm areas are generally subject to profuse perspiration. As a result, shirts treated in accordance with the invention are provided with underarm areas through which perspiration may pass but which are not wetted by the perspiration, and also remaining shirt areas which exhibit the normal perspiration absorbency of the untreated shirt material. In FIG. 1, the underarm area (12) of a shirt (10) is shown generally by stippling. In the preferred embodiment, the water-repellent material may be at least partially removed from the shirt by laundering. The various other components of perspiration, including salt, can readily be removed from the shirt at each laundering, and the underarm area can then be retreated with the water-repellent material before the shirt is again worn. Some minimal carry over of the water-repellent material can be tolerated, but care should be taken to avoid significant build-up of material. The Scotchguard brand fluorocarbon material referred to above carries over slightly from one laundering to the next but does not build up so as to significantly alter shirt material over the life of a shirt. Build up can also be controlled by omitting fresh application of water-repellent material to a shirt after every second or third laundering. I contemplate that cetian water-repellent materials may be bonded to shirt fabric through heat treatment during ironing or the like, rendering subsequent applications unnecessary.

While a preferred embodiment of the present invention has been described, it should be understood that various changes, adaptations and modifications may be made therein without departing from the spirit of the invention and the scope of the appended claims.

What is claimed is:

1. Method for treating a shirt of perspiration absorbent fabric made of fibrous threads to avoid underarm area wet perspiration stains, comprising applying to the other surface of solely the underarm areas a sufficient quantity of a water-repellent material to prevent absorption of perspiration into the fibrous threads of the fabric while permitting the transfer of perspiration through the fabric.

2. A shirt of perspiration-absorbent fabric made of fibrous threads, the shirt bearing, in underarm areas only, a sufficient quantity of a waterrepellent material to prevent absorption of perspiration into the fibrous threads in that area while permitting the transfer of perspiration therethrough.

3. The shirt of claim 2 wherein the water repellent material includes a non-toxic, water-insoluble fluorocarbon.

4. The shirt of claim 3 wherein the fluorocarbon is a fluoroaliphatic resin.

5. A shirt having underarm areas, the underarm areas being of a fabric of fibrous threads which are nonabsorbent of perspiration but which fabric permits the transfer of perspiration therethrough, and the non-underarm areas of the shirt being of a perspirationabsorbent fabric made of fibrous threads that absorb perspiration.

* * * * *

UNITED STATES PATENT AND TRADEMARK OFFICE

CERTIFICATE OF CORRECTION

PATENT NO. : 4,805,240

DATED : Feb. 21, 1989

INVENTOR(S) : Thomas T. Siqveland

It is certified that error appears in the above—identified patent and that said Letters Patent is hereby corrected as shown below:

Column 2, line 17, replace "inlcude" with --include--.

Column 2, line 23, replace "Scotchguard" with --Scotchgard--.

Column 3, line 4, replace "Scotchguard" with --Scotchgard--.

Column 3, line 10, replace "cetian" with --certain--.

Column 3, line 23, replace "other" with --outer--.

Column 4, line 7, replace "waterrepellent" with --water repellent--.

Column 4, line 22, replace "perspirationabsorbent" with --perspiration absorbent--.

Signed and Sealed this

Twentieth Day of June, 1989

*Attest:*

*Attesting Officer*

DONALD J. QUIGG

*Commissioner of Patents and Trademarks*